US009572401B1

(12) United States Patent
Haskins

(10) Patent No.: US 9,572,401 B1
(45) Date of Patent: Feb. 21, 2017

(54) FISHING AND HIKING BOOT WITH RECESSED CLEATS

(71) Applicant: Josey Haskins, Craig, CO (US)

(72) Inventor: Josey Haskins, Craig, CO (US)

( * ) Notice: Subject to any disclaimer, the term of this patent is extended or adjusted under 35 U.S.C. 154(b) by 0 days.

(21) Appl. No.: 14/598,571

(22) Filed: Jan. 16, 2015

Related U.S. Application Data

(63) Continuation-in-part of application No. 13/442,145, filed on Apr. 9, 2012, now abandoned.

(51) Int. Cl.

| | |
|---|---|
| ***A43C 15/02*** | (2006.01) |
| ***A43B 13/26*** | (2006.01) |
| ***A43B 5/00*** | (2006.01) |
| ***A43B 5/08*** | (2006.01) |

(52) U.S. Cl.
CPC ..... *A43B 13/26* (2013.01); *A43B 5/002* (2013.01); *A43B 5/08* (2013.01); *A43C 15/02* (2013.01)

(58) Field of Classification Search
CPC ..... A43B 13/26; A43B 5/002; A43B 5/08; A43C 15/02
USPC ..... 36/61, 62, 113, 114
See application file for complete search history.

(56) References Cited

U.S. PATENT DOCUMENTS

| | | | | | |
|---|---|---|---|---|---|
| 4,715,133 | A * | 12/1987 | Hartjes | A43B 5/001 | 36/127 |
| 4,782,604 | A * | 11/1988 | Wen-Shown | A43B 5/001 | 36/127 |
| 5,526,589 | A * | 6/1996 | Jordan | A43C 15/14 | 36/134 |
| 6,256,907 | B1 * | 7/2001 | Jordan | A43C 15/14 | 36/134 |
| 6,360,455 | B1 * | 3/2002 | Seo | A43C 15/14 | 36/134 |
| 6,675,504 | B1 * | 1/2004 | Biancucci | A43C 15/08 | 36/59 R |
| 6,698,110 | B1 * | 3/2004 | Robbins | A43B 5/185 | 36/134 |
| 7,836,610 | B2 * | 11/2010 | Laporte | A43C 15/08 | 36/62 |
| 2006/0174518 | A1 * | 8/2006 | Fogarty | A43B 13/223 | 36/61 |
| 2008/0271341 | A1 * | 11/2008 | Amark | A43C 15/14 | 36/61 |
| 2011/0126426 | A1 * | 6/2011 | mark | A43C 15/14 | 36/61 |

* cited by examiner

*Primary Examiner* — Jila M Mohandesi
(74) *Attorney, Agent, or Firm* — Edwin H. Crabtree; Ramon L. Pizarro

(57) ABSTRACT

A boot sole adapted for attachment of a bottom and lower sides of a fishing or hiking boot. The boot sole includes a recessed cavity for receiving one or more cleats therein. The cleats are used for engaging rough and irregular surfaces. The cleats are attached to an inner sole. The inner sole is attached to a bottom of the boot using heating bonding or an adhesive. Disposed around the recessed cavity is a downwardly extending sole ring. The sole ring includes a flat surface for engaging a smooth ground or floor surface.

11 Claims, 6 Drawing Sheets

FISHING AND HIKING BOOT WITH RECESSED CLEATS

This application is a Continuation-In-Part (CIP) patent application claiming the benefit and subject matter of a non-provisional patent application Ser. No. 13/442,145, filed on Apr. 9, 2012 and having a title of "Wading Boot Sole". The earlier filed non-provisional patent application claims the benefit and subject matter of a provisional patent application, Ser. No. 61/473,971, filed on Apr. 11, 2011.

BACKGROUND OF THE INVENTION (a) Field of the Invention

This invention relates to a fishing and hiking boot with a unique boot sole and more particularly, but not by way of limitation, to a boot sole having recessed cleats for engaging a rough and irregular surface when fishing and hiking for increased stability and safety. The boot sole also has an outer sole or sole ring with a flat bottom portion for engaging a smooth or flat floor surface.

(b) Discussion of Prior Art

Heretofore, fishing boots often have a flat bottom, which makes wading difficult and dangerous when negotiating rocks and gravel in a fishing stream or lake bed. Also, flat bottom boots often have a felt surface for improved traction. But, the felt surface helps transplant invasive aquatic species, which can destroy a river. Also, metal studs have been incorporated into a rubber boot sole. But, the studs wear out quickly and can't be used for walking on a bottom of a fishing boat or a floor surface.

In U.S. Pat. No. 7,836,610 to Laporte, a footwear item is disclosed having releasable attachments for engaging an outer sole. The attachments include spikes, studs, or cleats to improve traction when hiking and other sports activities. This type of footwear does not provide the unique features and objects of the subject invention having a plurality of recessed cleats incorporated into a boot sole as disclosed herein.

SUMMARY OF THE INVENTION

In view of the foregoing, it is a primary objective of the subject invention to provide one or more cleats incorporated into a recessed cavity of a fishing or hiking boot sole. The cleats are used for engaging rough and irregular surfaces, such as rocks, gravel and the like, with improved stability, greater traction, and safety when fishing and hiking.

Another object of the invention is the boot sole includes a downwardly extending, outer sole or sole ring having flat bottom surface. The sole ring is disposed round a periphery of the recessed cavity. The flat bottom surface of the sole ring is used for engaging a flat floor surface, such as the bottom of a fishing boat and other smooth surfaces, without marring or scuffing the floor surface.

The subject invention includes a boot sole adapted for attachment of a bottom and lower sides of a fishing or hiking boot. The boot sole includes a recessed cavity for receiving one or more cleats therein. The cleats are used for engaging rough and irregular surfaces. The cleats are attached to an inner sole. The inner sole is attached to a bottom of the boot using heating bonding or an adhesive. Disposed around the recessed cavity is a downwardly extending sole ring. The sole ring includes a flat surface for engaging a smooth ground or floor surface.

These and other objects of the present invention will become apparent to those familiar with different types of fishing and hiking boots when reviewing the following detailed description, showing novel construction, combination, and elements as described, and more particularly defined by the claims, it being understood that changes in the embodiments to the disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised and for the practical application of the subject fishing and hiking boot, and in which.

DETAILED DESCRIPTION OF THE PREFERRED EMBODIMENTS

Figure 1:
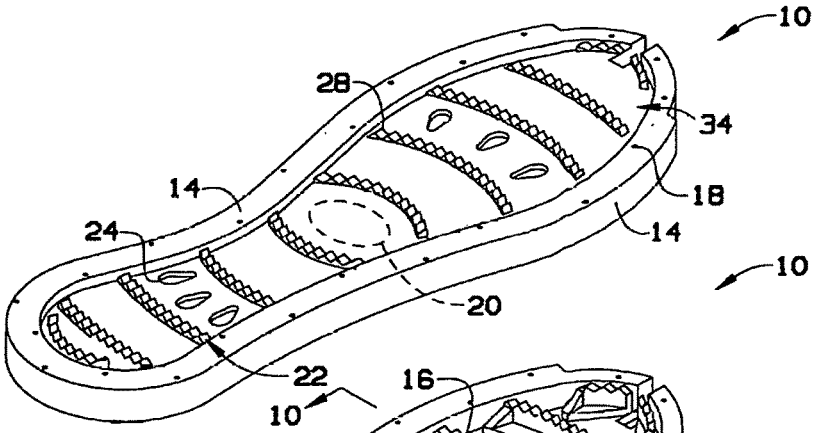
FIG. 1 illustrates a perspective view of the present invention.
Figure 2:
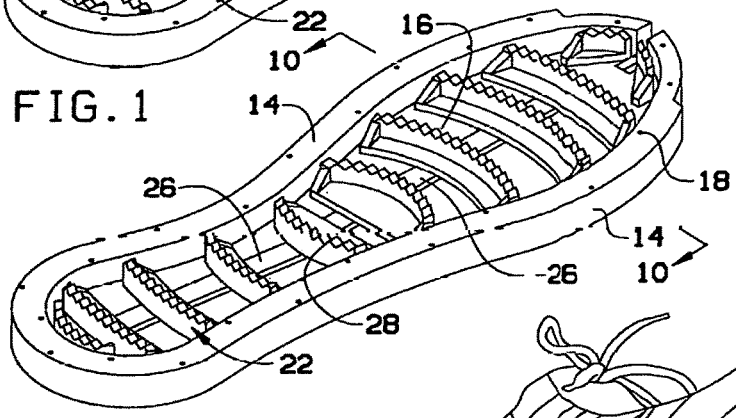
FIG. 2 illustrates a perspective view of the invention item 10 primary embodiment sole assembly intentionally omitting component 34 rubber matting for clarity.
Figure 3:
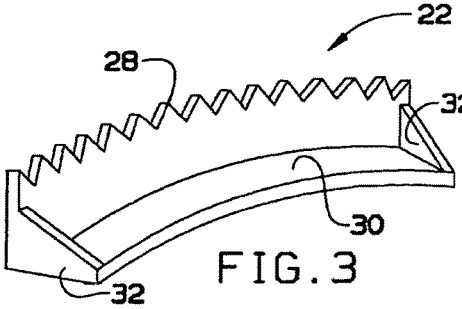
FIG. 3 illustrates a perspective view of the invention item 10 primary embodiment sole assembly illustrating component 22 cleat member only.
Figure 4:
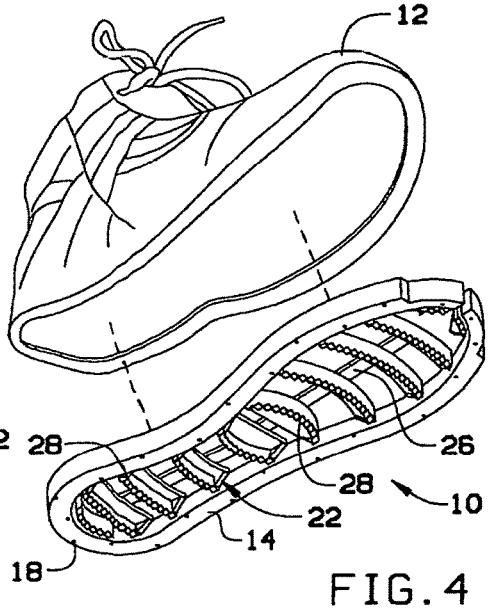
FIG. 4 illustrates a bottom perspective exploded view of the invention item 10 primary embodiment sole assembly illustrating intentionally omitting component 34 rubber matting for clarity.
Figure 5:
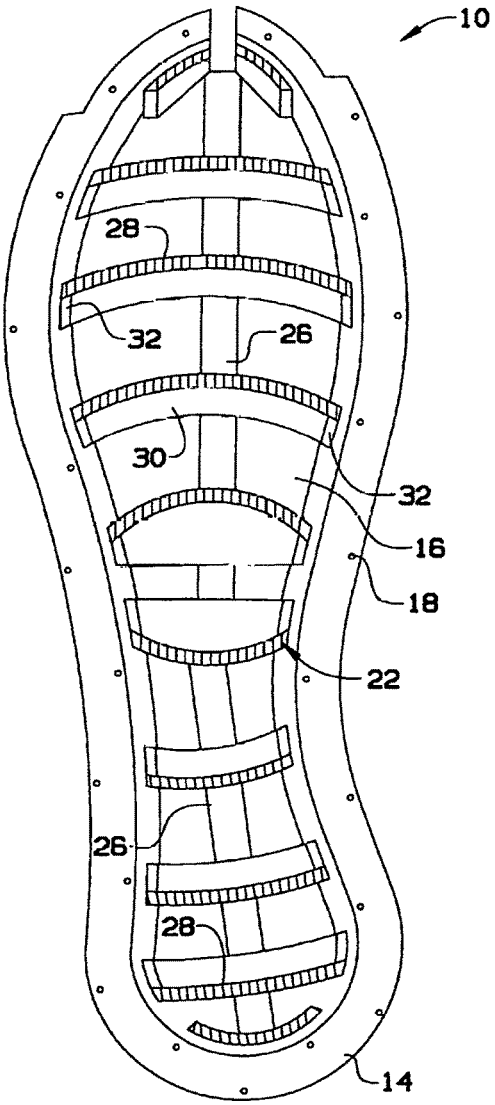
FIG. 5 illustrates a bottom view of the invention item 10 primary sole assembly intentionally omitting component 34 rubber matting for clarity.
Figure 6:
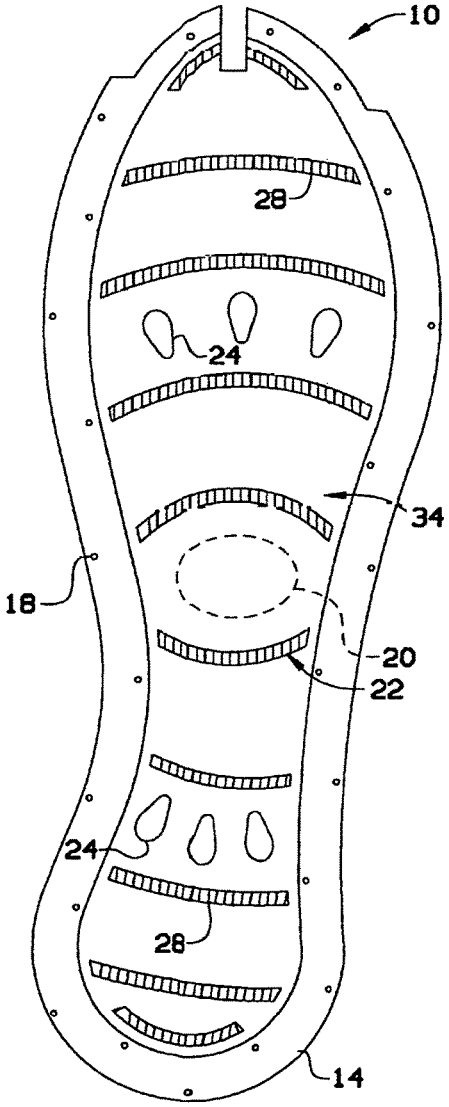
FIG. 6 illustrates a bottom view of the invention item 10 primary embodiment sole assembly illustrated with component 34 rubber matting.
Figure 7:
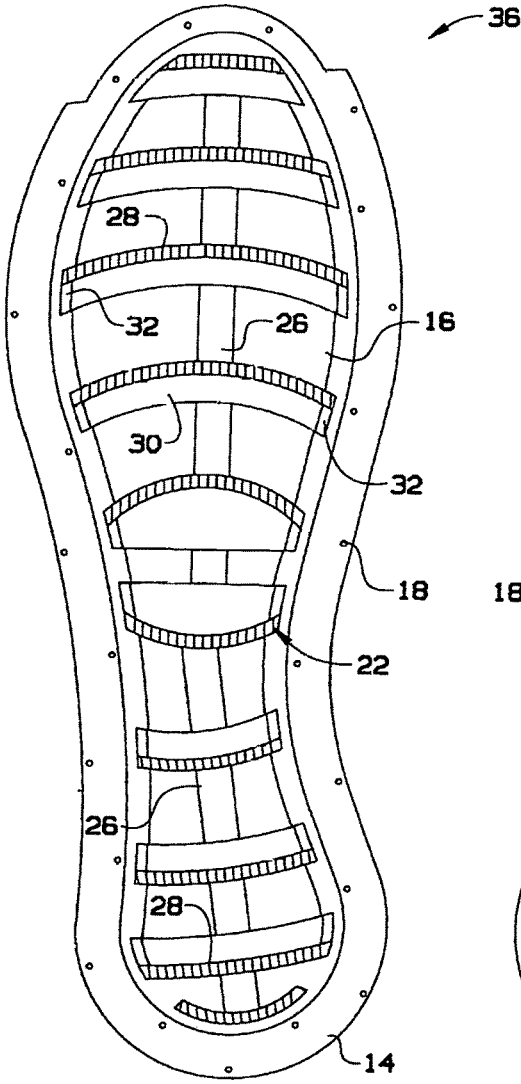
FIG. 7 illustrates a bottom view of the invention item 36 secondary embodiment sole assembly intentionally omitting component 34 rubber matting for clarity.
Figure 8:
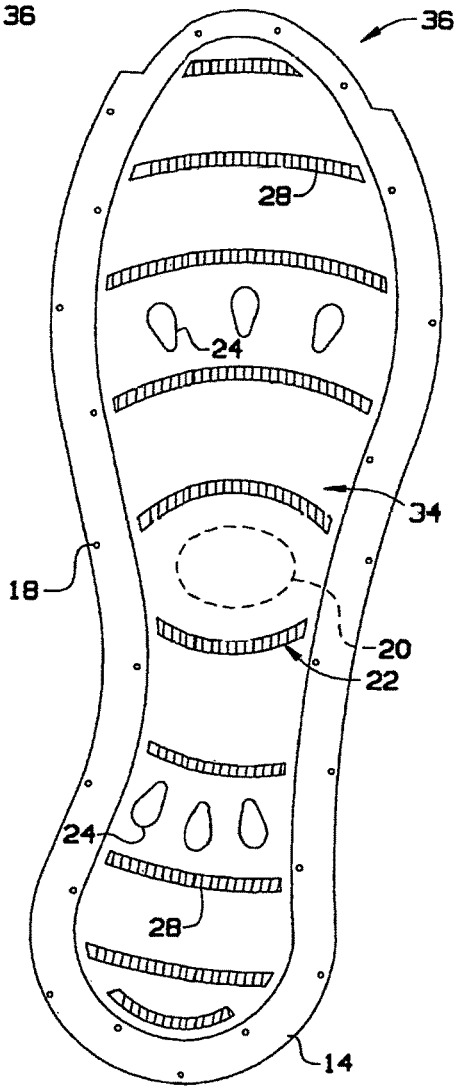
FIG. 8 illustrates a bottom view of the invention item 36 secondary embodiment sole assembly illustrated with component 34 rubber matting.
Figure 9:
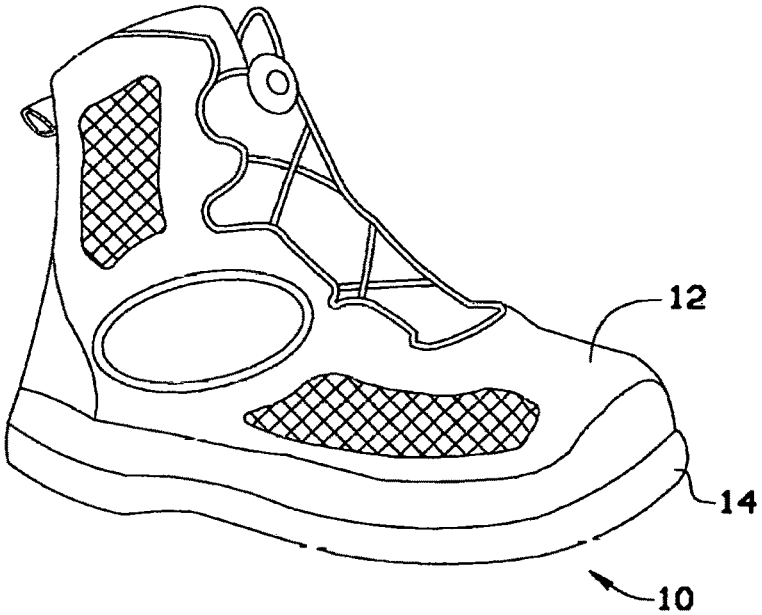
FIG. 9 illustrates a perspective view shown in use.
Figure 10:
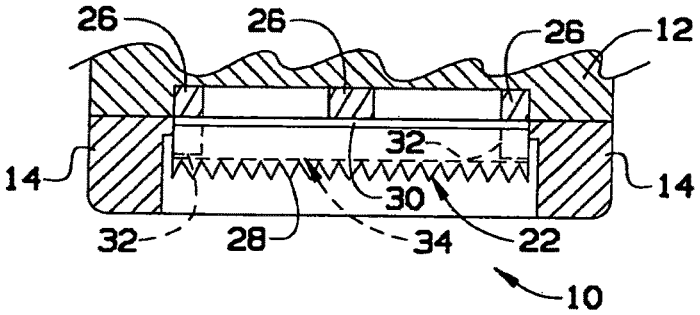
FIG. 10 illustrates a section detail view of the invention along line 10-10 in FIG. 2.

The present invention relates to a design for a wading boot sole 10 for fishing to provide maximum traction on slick river bottoms and eliminate the transfer of aquatic species. The sole 10 comprises an outer bottom rim sole 14 and an inner sole 16. The inner sole 16 comprises a plurality of elongated cleat members 22 having first and second ends and including a base portion 30, a grip portion 28 formed at an angle relative to the base portion 30 and first and second gussets 32 formed at the first and second ends and extending between the base portion 30 and the grip portion 28. The grip portions 28 include a row of teeth extending along the grip portion 28 between the first and second ends. The plurality of the elongated cleat members 22 extend approximately parallel and spaced apart from one another as seen in FIGS. 1, 2 and 4-8. As seen in FIGS. 1, 6 and 8, the plurality of base portions 30 of the elongated cleat members 22 are surrounded by a matting 34 having top and bottom surfaces and preferably made from rubber.

Cleat members 22 will be comprised of one of the materials selected from aluminum, aluminum alloy, titanium, titanium alloy, steel, silicon carbide, tungsten carbide, vanadium carbide, carbide, niobium carbide, carbide steel. In some embodiments, the dimensions will be 1/64 to 3/8 inch thick, 1/16 to 4 inch wide and 1 to 8 inch long. Cleat members 22 will span the total width of inner sole 16. They will be a half-circle shape, from 1 degree radius, or run straight. Members 22 vary from 1/16 to 2 inches in height. Cleat base 30 will be the mounting plate to attach the cleats to the inner sole 16 or frame members 26 by weld. Between 1 and 100 teeth will be formed per grip member 28. Gussets 32 will be placed on the outside edge of the cleat member 22 and in the middle on the opposite side of the cleat members 22. The dimensions will be 1'64 to 3/8 inch thick, 1/32 to 1½ inch wide, 1/16 to 1½ inch long, and 5 degrees to 80 degrees angel. They will act as supports for the cleat members 22.

The inner sole 16 also comprises a plurality of elongate frame members 26 extending generally perpendicular to the elongate cleat members 22. The plurality of elongate frame members 26 are also surrounded by the rubber matting 34 which includes a plurality of boot drainage holes 24 formed therein. The elongate frame members 26 act as a mount and cross-brace for cleat base members 30.

The cleat frame members 26 will be comprised of one to the materials selected from selected from aluminum, aluminum alloy, titanium, titanium alloy, steel, silicon carbide, tungsten carbide, vanadium carbide, carbide, niobium carbide, carbide steel. The dimensions will be 1/8 to 5 inch wide, 1/64 to 1/4 inch thick. Length will depend on boot size. They will be positioned either horizontal, or parallel to the outer bottom rim sole 14. In some embodiments, the frame members 26 are not present. As seen in FIGS. 1, 6 and 8, the elongate frame members 26 are also preferably surrounded by matting 34.

An outer bottom rim sole 14 surrounds the matting 34 and is defined by an outer surface, an inner surface, a top surface and a bottom surface. The top surface of the j outer bottom rim sole 14 is spaced apart from the top surface of the matting 34 in a first direction and the bottom surface of said outer bottom rim sole 14 is spaced apart from the bottom surface of the matting 34 in a second direction which is opposite from the first direction. A plurality of metal studs 18 are formed on the bottom surface of the outer bottom rim sole.

The outer bottom rim sole 14 provides a walking platform for use other than the river bottom. Where the recess at the matting 34 allows the cleat teeth to be protected when walking down the highway or dirt road. The cleat members 22 may be welded to the inner sole 16 that would be the shape of the recessed part of the sole and tilt up inside the outer bottom rim sole 14.

The bottom surface of the outer bottom rim sole 14 is spaced apart from the row of teeth in a first direction such that when the bottom surface of the outer bottom rim sole 14 is placed on a foreign surface, the teeth are spaced apart from the foreign surface to prevent scratching thereof and to prevent dulling of the teeth.

The dimensions for the inner sole 16 will be 1/64 to 1 inch thick, and shaped to match the bottom of the boot. It will act as a mounting platform for the cleat members 22. There will be 1/8 to 1 inch holes 24 cut in the inner sole 16 and covered from the backside with PVC reinforced mesh to allow the water to drain form the bottom of the boot.

The outer bottom rim sole 14 will be comprised of rubber. The dimensions will be 1/8 to 2½ inches wide, 1/8 to 2½ inches thick, and wrap around the whole outside of from selected from aluminum, aluminum alloy, titanium, titanium alloy, steel, silicon carbide, tungsten carbide, vanadium carbide, carbide, niobium carbide, carbide steel. The dimensions will be 1/8 to 5 inch wide, 1/64 to 1/4 inch thick. Length will depend on boot the boot. This will act as the walking surface when a user is out of the water. There will also be from 1 to 30 studs 18, comprising of one of the materials selected from aluminum, aluminum alloy, titanium, titanium alloy, steel, silicon carbide, tungsten carbide, vanadium carbide, carbide, niobium carbide, carbide steel, spaced as desired in the outer bottom rim sole 14 as shown in FIGS. 1, 2 and 4-8. The outer sole 14 is made of rubber.

In construction, first the inner sole 16 would be cut and shaped to match the bottom of the boot 12. Then holes would be cut in the inner sole 16 at the desired places and cover with PVC reinforced mesh form the top side, so it is sandwiched between the bottom of the boot and the inner sole 16. Next the cleat members 22 are cut to size and the teeth are cut out. Then the cleat members 22 can be welded to the inner sole 16 in the desired pattern. Then the gussets 32 should be inserted in their desired spots and welded. Next the outer bottom rim sole 14 would be molded out of rubber and the studs 18 inserted in their desired positions. Then the whole outer bottom rim sole 15 will be pressed on the bottom of the boot. Then rubber matting 34 will be inlayed over the inner sole 16 to protect the cleat base 30 and gussets 32 from rocks.

In some embodiments, the cleat members 22 are replaceable. To use the invention, a user places the soles on their feet to cross the slickest river bottom. It would be excellent for older people who enjoy fly-fishing.

Figure 11:
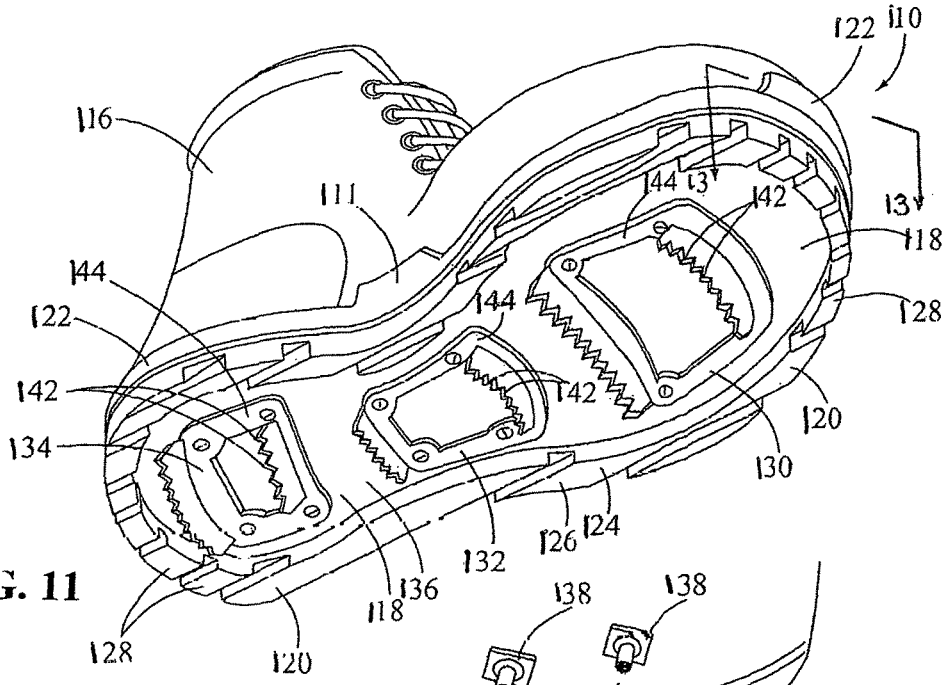
FIG. 11 is a perspective view of the subject fishing and hiking boot with a boot sole having a recessed cavity for attaching recessed cleats to an inner sole. An outer sole or sole ring is disposed around the recessed cavity.
Figure 13:
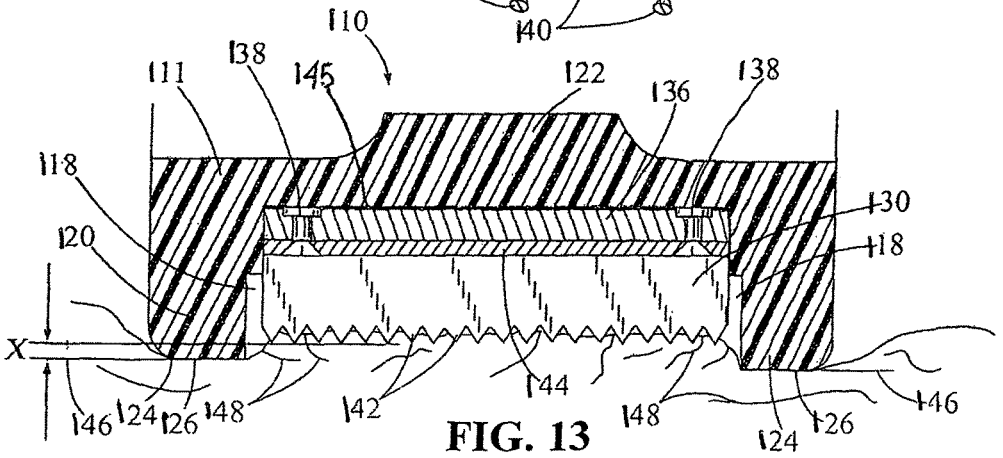
FIG. 13 is a cross sectional view of the boot sole taken along lines 3-3, shown in FIG. 11.

In FIG. 11, a perspective view of another boot sole is shown having general reference numeral 110. The boot sole 110 includes a boot sole body 111. The boot sole body 111 is shown attached to a bottom 112 and lower sides 114 of a fishing and hiking boot 116. The bottom 112 of the boot 116 is shown in FIG. 13.

The boot sole body 111 is characterized by having a recessed cavity 118 therein and an outer sole or sole ring 120 disposed around the outer perimeter of the cavity 118. An upper portion 122 of the sole ring 120 is used for securing the boot sole to the lower sides 114 of the boot 116. A lower portion 124 of the sole ring 120 has a flat surface 126 with treads 128 therein for better traction.

The cavity 118 is used for receiving a toe cleat 130, an arch cleat 132 and a heal cleat 134 therein. The cleats 130, 132 and 134 are attached to an inner sole 136, as shown in FIG. 12.

Figure 12:
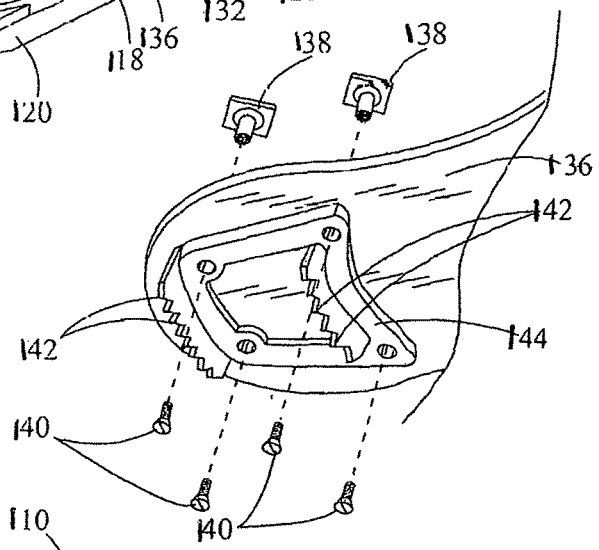
FIG. 12 is a perspective view of one of the cleats shown being attached to a portion of the inner sole.

In FIG. 12, a perspective view of the heal cleat 130 is shown being attached to a portion of the inner sole 136 using threaded inserts 138 and screws 140. The cleats 130, 132 and 134 include a pair of spaced apart semi-circular cleat teeth 142, mounted on a cleat frame 144. The cleat teeth are used for gripping an irregular or rocky surface, as shown in FIG. 13. By removing the screws 140, the cleats can be replaced when worn or damaged.

In FIG. 13, a cross sectional view of the boot sole body 111 is shown taken along lines 13-13 in FIG. 11. In this view, the inner sole 136 is bonded to the bottom 112 of the boot 116. The bonding is illustrated as horizontal line 145. The inner sole 136 is shown with a pair of threaded inserts 138 attached to the cleat frame 144 of the toe cleat 130. It is important to note that in this drawing the bottom of the cleat teeth 142 are recessed above the flat surface 126 of the sole ring 120 a distance "X". The recessed distance "X" is in a range of 1/64 to 1/2 inches and greater so that the teeth 142 with not engage, scar and damage a flat floor surface when walked on.

Also shown in FIG. 13 is a flat surface shown as a horizontal line 146. Further shown in this drawing is an irregular or rocky surface 148, which is engaged by the cleat teeth 142 for greater stability, traction and safety, when fishing and hiking.

Figure 14:
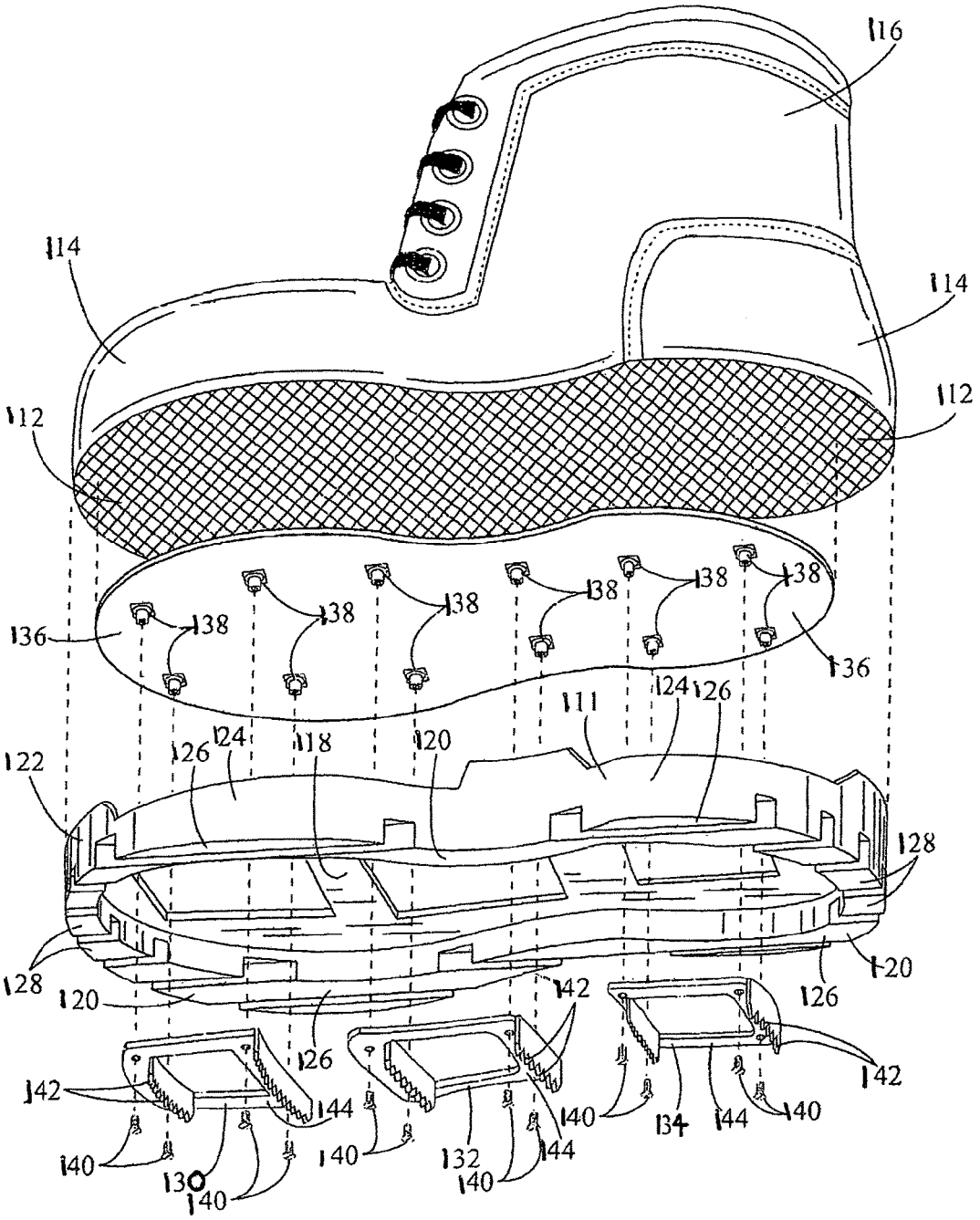
FIG. 14 is an exploded perspective view of the boot, inner sole, cleats and surrounding sole ring.

In FIG. 14, an exploded perspective view is shown of the boot 116, inner sole 136, cleats 130, 132, and 134 and the surrounding sole ring 120. The inner sole 136 is shown with a plurality of spaced apart threaded inserts 138 for receiving screws 140 and securing the cleats 130, 132 and 134 thereto when the sole 136 has been bonded to the bottom 112 of the boot 116. Also shown in this drawing is the sole ring 120 positioned for attaching the boot sole body 111 to a portion of the bottom 112 and lower sides 114 of the boot 116 and bonded thereto.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A boot sole adapted for attachment of a bottom and lower sides of a fishing or hiking boot, the boot sole comprising:

a boot sole body adapted for bonding to a bottom of the boot, the boot sole body having a recessed cavity therein;

at least one cleat with cleat teeth, the cleat teeth adapted for engaging rocky and irregular surfaces, the cleat received and held in a fixed and non-movable position in the recessed cavity;

an inner sole adapted for bonding to the bottom of the boot, the cleat attached to a portion of the inner sole; and a sole ring in the boot sole body and disposed around the perimeter of the recessed cavity, the sole ring having a flat surface for engaging a smooth ground or floor surface, the bottom of the cleat teeth recessed a distance "X" in a range of 1/64 to 1/2 inches and greater above the flat surface of the sole ring to prevent damage to a flat floor surface when walked on.

2. The boot sole as described in claim 1 further including a plurality of cleats attached to the inner sole.

3. The boot sole as described in claim 2 wherein the cleats include a heel cleat, an arch cleat and a toe cleat attached to the inner sole.

4. The boot sole as described in claim 3 wherein the cleats include a cleat frame and a pair of spaced apart semi-circular cleat teeth.

5. The boot sole as described in claim 2 further including a plurality of threaded inserts and screws for securing the cleats to the inner sole.

6. The boot sole as described in claim 1 wherein the flat surface of the sole ring includes treads therein for providing traction when walking on a smooth or flat surface.

7. A boot sole adapted for attachment of a bottom and lower sides of a fishing or hiking boot, the boot sole comprising:

a boot sole body adapted for bonding to a bottom of the boot, the boot sole body having a recessed cavity therein;

a plurality of cleats with cleat teeth, the cleat teeth adapted for engaging rocky and irregular surfaces, the cleats spaced apart and received in the recessed cavity the cleats held in a fixed and non-movable position in the recessed cavity;

an inner sole adapted for bonding to the bottom of the boot, the cleats attached to a portion of the inner sole; and a sole ring in the boot sole body and disposed around the perimeter of the recessed cavity, the sole ring having a flat surface for engaging a smooth ground or floor surface, the bottom of the cleat teeth on the cleats recessed a distance "X" in a range of 1/64 to 1/2 inches and greater above the flat surface of the sole ring to prevent the cleat teeth from engaging a flat ground surface or flat floor surface.

8. The boot sole as described in claim 7 further including a heel cleat, an arch cleat, and a toe cleat attached to the inner sole.

9. The boot sole as described in claim 7 wherein the cleats include a cleat frame and a pair of spaced apart semi-circular cleat teeth mounted on the cleat frame.

10. The boot sole as described in claim 7 further including a plurality of threaded inserts and screws for securing the cleats to the inner sole.

11. The boot sole as described in claim 7 wherein the flat surface of the sole ring includes treads therein for providing traction when walking on a smooth or flat surface.

* * * * *